US012011096B1

(12) United States Patent
Li

(10) Patent No.: US 12,011,096 B1
(45) Date of Patent: Jun. 18, 2024

(54) AIR MATTRESS

(71) Applicant: Shenzhen Ruiche Technology Innovation Co., Ltd., Shenzhen (CN)

(72) Inventor: Ping Li, Shenzhen (CN)

( * ) Notice: Subject to any disclaimer, the term of this patent is extended or adjusted under 35 U.S.C. 154(b) by 0 days.

(21) Appl. No.: 18/490,641

(22) Filed: Oct. 19, 2023

(30) Foreign Application Priority Data

Sep. 12, 2023 (CN) ..... 202322480088.9

(51) Int. Cl.
*A47C 27/08* (2006.01)

(52) U.S. Cl.
CPC ..... *A47C 27/082* (2013.01)

(58) Field of Classification Search
CPC ..... A47C 27/08; A47C 27/081; A47C 27/082; A47C 27/083; A47C 27/084; A47C 27/10; A61G 7/05; A61G 7/05746; A61G 7/05753; A61G 7/05761; A61G 7/05769; A61G 7/05776; A61G 7/05784; A61G 7/05792
See application file for complete search history.

(56) References Cited

U.S. PATENT DOCUMENTS 4,177,972 A * 12/1979 Legris ..... F16K 5/0647 411/522
4,829,616 A * 5/1989 Walker ..... F04D 25/084 251/129.05
5,373,595 A * 12/1994 Johnson ..... A61G 7/05776 285/361
2008/0066818 A1* 3/2008 Nicolini ..... F16K 3/08 137/878
2010/0014993 A1* 1/2010 Wang ..... F04D 25/084 5/713
2010/0278659 A1* 11/2010 Wang ..... F04B 49/022 417/43
2012/0304391 A1* 12/2012 Driscoll, Jr. ..... F04D 17/161 5/710
2015/0233485 A1* 8/2015 Cheng ..... F16K 1/52 251/113
2016/0022520 A1* 1/2016 Streeter ..... A61B 5/1036 137/625.46
2016/0051060 A1* 2/2016 Huang ..... A61G 7/05769 137/223
2016/0199248 A1* 7/2016 Jackson ..... A47C 7/024 601/134
2016/0215780 A1* 7/2016 Liu ..... F04D 29/503
2016/0242562 A1* 8/2016 Karschnik ..... A47C 27/082
2017/0196368 A1* 7/2017 Liu ..... A47C 27/16
(Continued)

*Primary Examiner* — Justin C Mikowski
*Assistant Examiner* — George Sun

(57) ABSTRACT

An air mattress relates to the field of air mattresses. The air mattress includes a mattress main body, an inflation and deflation device. The mattress main body is provided with an inflation chamber and a first airflow channel. The inflation chamber is communicated to the first airflow channel. The inflation and deflation device includes a driving device, a first air inlet and a first air outlet. When the first air outlet is communicated to the first airflow channel, the inflation and deflation device is in an inflation state, and the driving device is configured to drive external air to pass through the first air inlet and the first air outlet in sequence to form an inflation airflow discharged from the first air outlet; and the inflation airflow discharged from the first air outlet fills the inflation chamber through the first airflow channel to inflate the mattress main body.

15 Claims, 9 Drawing Sheets

(56) References Cited

U.S. PATENT DOCUMENTS

| | | | | |
|---|---|---|---|---|
| 2018/0116420 | A1* | 5/2018 | Shakal | H02J 50/12 |
| 2019/0151175 | A1* | 5/2019 | Kelch | A61G 7/05776 |
| 2019/0211829 | A1* | 7/2019 | Huang | F04D 25/166 |
| 2020/0386237 | A1* | 12/2020 | Huang | F04D 25/08 |
| 2020/0400149 | A1* | 12/2020 | Huang | F04D 29/601 |
| 2022/0065257 | A1* | 3/2022 | Huang | F04D 27/008 |

* cited by examiner

AIR MATTRESS

CROSS-REFERENCE TO RELATED APPLICATIONS

The application claims priority of Chinese patent application CN2023224800889, filed on 12 Sep. 2023, which is incorporated herein by reference in its entireties.

TECHNICAL FIELD

The present disclosure relates to the field of air mattresses, and particularly, to an air mattress.

BACKGROUND

The emergence of air mattresses has overcome the drawback of the bulkiness of traditional furniture, and an air mattress can be placed indoors or outdoors at will and has the advantages of small size after deflation, easy storage, and portability.

At present, most air mattresses on the market need to be manually inflated and deflated. An air mattress is usually provided with an inflation port and a deflation port which are located at different positions of the air mattress. After inflation, if deflation is required, the deflation port needs to be opened, which takes up a space and is inconvenient to operate.

SUMMARY

The present disclosure aims to provide an air mattress to solve the shortcomings and deficiencies in the prior art. The air mattress can be automatically inflated and deflated through an inflation and deflation device as a switching device is arranged in the inflation and deflation device, and only one air outlet is provided, which is simple and convenient.

The technical solution of the present disclosure is as follows:

An air mattress includes a mattress main body, an inflation and deflation device.

The mattress main body is provided with an inflation chamber and a first airflow channel, and the inflation chamber is communicated to the first airflow channel;

The inflation and deflation device includes a driving device; an output end of the driving device is a first air inlet and a first air outlet; when the first air outlet is communicated to the first airflow channel, the inflation and deflation device is in an inflation state, and the driving device is configured to drive external air to pass through the first air inlet and the first air outlet in sequence to form an inflation airflow discharged from the first air outlet; and the inflation airflow discharged from the first air outlet fills the inflation chamber through the first airflow channel to inflate the mattress main body.

Preferably, when the first air inlet is communicated to the first airflow channel, the inflation and deflation device is in a deflation state, and the driving device is configured to drive the air in the inflation chamber to pass through the first air inlet and the first air outlet in sequence to form an exhaust airflow discharged from the first air outlet to the outside to deflate the mattress main body.

Preferably, the inflation and deflation device further includes a switching device; the switching device is configured to switch the inflation and deflation device between the inflation state and the deflation state; when the switching device switches the first air outlet to be communicated to the first airflow channel, the inflation and deflation device is in the inflation state, and the driving device is configured to drive the external air to pass through the first air inlet and the first air outlet in sequence to form the inflation airflow discharged from the first air outlet; the inflation airflow discharged from the first air outlet fills the inflation chamber through the first airflow channel to inflate the mattress main body; and when the switching device switches the first air inlet to be communicated to the first airflow channel, the inflation and deflation device is in the deflation state, and the driving device is configured to drive the air in the inflation chamber to pass through the first air inlet and the first air outlet in sequence to form the exhaust airflow discharged from the first air outlet to the outside to deflate the mattress main body.

Preferably, the inflation and deflation device further includes a mounting housing, and the driving device is arranged inside the mounting housing.

Preferably, the switching device is arranged on the mounting housing; the driving device is provided with a conducting switch; the switching device includes a push switch, a switching gate, and a first pushing device; the switching gate is arranged between the first airflow channel and the first air inlet; a second airflow channel is arranged on the switching gate; one end of the second airflow channel is communicated to the first airflow channel, and the other end of the second airflow channel is located at the first air inlet or the first air outlet; the switching gate is connected to the first pushing device; the first pushing device pushes the switching gate to switch the other end of the second airflow channel to be located at the first air outlet, and the second airflow channel is communicated to the first air outlet; the push switch includes a deflation switch; when the deflation switch is triggered, the conducting switch is triggered to cause the driving device to be in a working state; the deflation switch is configured to push the switching gate to switch the second airflow channel to be located at the first air inlet; and the second airflow channel is communicated to the first air inlet.

Preferably, the first airflow channel is internally provided with a second pushing device and a sealing element; the second pushing device is connected to the sealing element; and the second pushing device is configured to push the sealing element to seal the first airflow channel.

Preferably, the sealing element is provided with a first push rod; the second pushing device pushes the first push rod; the sealing element seals the first airflow channel; the switching gate is provided with a third pushing device; in the inflation state, the inflation airflow pushes the sealing element in a direction away from the first airflow channel, so as to release the sealing of the sealing element on the first airflow channel; when the deflation switch is triggered, the deflation switch is configured to push the switching gate to communicate the second airflow channel to the first air inlet; and the third pushing device pushes the first push rod to cause the first push rod to push the sealing element in the direction away from the first airflow channel, so as to release the sealing of the sealing element on the first airflow channel.

Preferably, the second pushing device includes a first spring and a limiting plate; two ends of the first spring are respectively connected to the first push rod and the limiting plate; the first spring sleeves the first push rod; the first spring abuts against the limiting plate; in the inflation state, the inflation airflow pushes the sealing element in the direction away from the first airflow channel, so as to release the sealing of the sealing element on the first airflow channel; the first spring is compressed in a direction close to the limiting plate; the first spring generates a reset force; when the deflation switch is triggered, the deflation switch is configured to push the switching gate to communicate the second airflow channel to the first air inlet; the third pushing device pushes the first push rod to cause the first push rod to push the sealing element in the direction away from the first airflow channel, so as to release the sealing of the sealing element on the first airflow channel; the first spring is compressed in the direction close to the limiting plate; and the first spring generates the reset force.

Preferably, the push switch further includes an inflation switch; when the inflation switch is triggered, the conducting switch is triggered to cause the driving device to be in the working state; the driving device is configured to drive the external air to pass through the first air inlet and the first air outlet in sequence, so as to form the inflation airflow discharged from the first air outlet; the inflation airflow pushes the sealing element in the direction away from the first airflow channel, so as to release the sealing of the sealing element on the first airflow channel; the push switch further includes a reset switch; the reset switch is configured to release the triggering on the inflation switch and the driving device, so that the driving device is in a non-working state to eliminate the inflation airflow, so as to cause the second pushing device to push the sealing element to seal the first airflow channel; and the reset switch is further configured to release the triggering on the deflation switch and the driving device, so that the driving device is in the non-working state to release the pushing on the first push rod by the third pushing device, and the second pushing device pushes the sealing element to seal the first airflow channel.

Preferably, the switching device further includes a pushing plate; when the inflation switch is triggered, the inflation switch pushes the pushing plate towards the conducting switch, causing the pushing plate to push the conducting switch to trigger the conducting switch; when the deflation switch is triggered, the inflation switch pushes the pushing plate towards the conducting switch, causing the pushing plate to push the conducting switch to trigger the conducting switch; and when the reset switch is triggered, the reset switch is configured to push the pushing plate in a direction away from the conducting switch to release the triggering on the conducting switch.

Preferably, the inflation switch includes an inflation push portion, an inflation push rod, and a second spring; the inflation push portion is connected to the inflation push rod; the second spring sleeves the inflation push rod; when the push portion is triggered, the second spring is compressed, and the inflation push rod pushes the pushing plate towards the conducting switch, causing the pushing plate to push the conducting switch, so that the driving device is in the working state; the deflation switch includes a deflation push portion, a deflation push rod, and a third spring; the deflation push portion is connected to the deflation push rod; the third spring sleeves the deflation push rod; when the deflation push portion is triggered, the third spring is compressed, and the deflation push rod pushes the pushing plate towards the conducting switch, causing the pushing plate to push the conducting switch, so that the driving device is in the working state; the reset switch includes a reset push portion, a reset push rod, and a fourth spring; the reset push portion is connected to the reset push rod; the fourth spring sleeves the reset push rod; when the reset push portion is triggered, the reset push rod pushes the pushing plate in the direction away from the conducting switch; and an elastic reset force generated by compression of the fourth spring pushes the reset push rod and the reset push portion to be reset in a direction away from the pushing plate.

Preferably, the pushing plate is provided with a first elastic member; the first elastic member is configured to push the pushing plate towards one side away from the conducting switch, and the inflation push rod is further provided with a first locking groove; when the inflation push portion is triggered, the inflation push rod pushes the pushing plate towards the conducting switch; the first elastic member is compressed, and the second spring is compressed, so that the pushing plate pushes the conducting switch, and an elastic reset force generated by the compression of the second spring presses the pushing plate into the first locking groove to cause the inflation push portion to be in a triggered state; the deflation push rod is further provided with a second locking groove; when the deflation push portion is triggered, the deflation push rod pushes the pushing plate towards the conducting switch; the first elastic member is compressed, and the third spring is compressed, so that the pushing plate pushes the conducting switch, and an elastic reset force generated by the compression of the third spring presses the pushing plate into the second locking groove to cause the deflation push portion to be in a triggered state; when the reset push portion is triggered, the reset push rod pushes the pushing plate towards a direction close to the first elastic member, and the first elastic member is compressed; the first elastic member is configured to push the pushing plate towards the side away from the conducting switch, and the fourth spring is compressed; and an elastic reset force generated by the compression of the fourth spring pushes the reset push rod and the reset push portion to be reset in the direction away from the pushing plate.

Preferably, the pushing plate is provided with an inflation through hole, a deflation through hole, and a reset through hole; the inflation through hole allows the inflation push rod to pass through; the deflation through hole allows the deflation push rod to pass through; the reset through hole allows the reset push rod to pass through; the second spring, the third spring, and the fourth spring are respectively connected to a fixed plate; the fixed plate is respectively provided with an inflation opening, a deflation opening, and a reset opening allowing the inflation push rod, the deflation push rod, and the reset push rod to pass through; when the inflation push portion is triggered, the inflation push rod passes through the inflation through hole and the inflation opening, and the inflation push rod pushes the pushing plate towards the conducting switch, causing the pushing plate to push the conducting switch; the first elastic member is compressed, and the second spring abuts against the fixed plate and is compressed; the elastic reset force generated by the compression of the second spring presses the pushing plate into the first locking groove; the first locking groove is clamped on an outer wall of the inflation through hole to cause the inflation push portion to be in a triggered state; when the deflation push portion is triggered, the deflation push rod passes through the deflation through hole and the deflation opening, and the deflation push rod pushes the pushing plate towards the conducting switch, causing the pushing plate to push the conducting switch; the first elastic member is compressed, and the third spring abuts against the fixed plate and is compressed; the elastic reset force generated by the compression of the third spring presses the pushing plate into the second locking groove; the second locking groove is clamped on an outer wall of the deflation through hole to cause the deflation push portion to be in a triggered state; when the reset push portion is triggered, the reset push rod passes through the reset through hole and the reset opening, and the reset push rod pushes the pushing plate towards the conducting switch; the first elastic member is compressed, and the first elastic member is configured to push the pushing plate towards the side away from the conducting switch; the fourth spring abuts against the fixed plate and is compressed; and the elastic reset force generated by the compression of the fourth spring pushes the reset push rod and the reset push portion to be reset in the direction away from the pushing plate.

Preferably, the driving device further includes a fan and a circuit board; the fan is configured to transfer an airflow to the air mattress for inflation and deflation; the circuit board is electrically connected to the fan; the conducting switch is electrically connected to the circuit board; the conducting switch and the circuit board jointly control a working state of the fan; a USB interface is formed in a surface of the mounting housing; the USB interface is electrically connected to the circuit board; the USB interface is electrically connected to an external power source; and the external power source is configured to supply power to the driving device.

Preferably, the fan is provided with a fan casing; the fan casing is arranged inside the mounting housing; an output end of the fan includes the first air inlet and the first air outlet; and the first air inlet is arranged below the first air outlet.

Preferably, the fan is provided with a fan casing; and the fan casing is arranged inside the mounting housing.

Preferably, the mounting housing is provided with an air vent for the fan to suck air into and discharge air out of the air mattress in the inflation and deflation states.

Preferably, the mattress main body further includes an accommodating housing; the accommodating housing is configured to accommodate the inflation and deflation device; the accommodating housing is provided with a cover; one end of the cover is rotatably connected to the accommodating housing, and the other end of the cover is provided with a clamping slot; the other end of the accommodating housing is provided with a buckle structure; the buckle structure includes a control button and a clamping block; the control button controls expansion and contraction of the clamping block; the clamping block is embedded in the clamping slot; in a stationary state, the clamping block is embedded in the clamping slot, and the cover seals the accommodating housing; the control button is triggered, so that the clamping block is separated from the clamping slot; and the cover rotates around one side of the accommodating housing to release the sealing of the cover on the accommodating housing.

Preferably, the first airflow channel is arranged on the accommodating housing; the accommodating housing is provided with an outer side wall and an inner side wall; the inner side wall is encircled to form an accommodating chamber; the inflation and deflation device is arranged in the accommodating chamber; the outer side wall is provided with a stop edge; the sealing element is arranged on the outer side wall; and the stop edge is configured to stop the sealing element on the outer side wall.

Preferably, the mattress main body includes a first mattress inner wall and a second mattress inner wall; a number of third airflow channels are arranged between the first mattress inner wall and the second mattress inner wall; the third airflow channels include a first connecting wall and a second connecting wall; two ends of the first connecting wall and two ends of the second connecting wall are respectively connected to the first mattress inner wall and the second mattress inner wall; a distance is reserved between the two ends of the first connecting wall and the two ends of the second connecting wall; the third airflow channels are formed between the two ends of the first connecting wall and the two ends of the second connecting wall; and the third airflow channels are uniformly distributed between the first mattress inner wall and the second mattress inner wall.

By the adoption of the above technical solutions, the present disclosure has the following beneficial effects.

1. In the present disclosure, due to the arrangement of the switching device in the inflation and deflation device, the inflation and deflation device can achieve inflation and deflation of the air mattress without a need for manual extraction, which saves time and is easy to operate.

2. In the present disclosure, the stop edge is arranged on the outer wall of the accommodating housing to stop the sealing element on the outer side wall and prevent the sealing element from entering the first airflow channel under the driving of the deflation airflow as it may cause an accident in the deflation process.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

Figure 1:
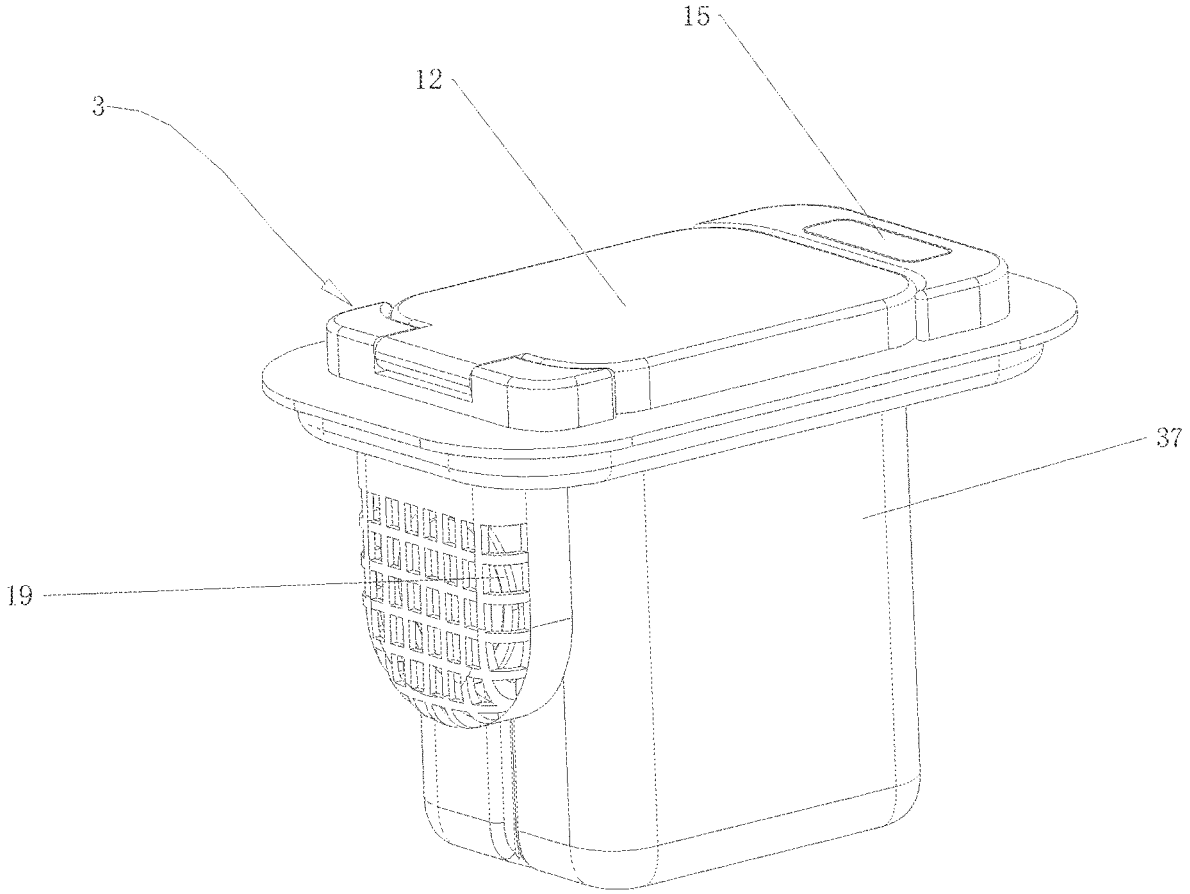
FIG. 1 is a schematic diagram of a partial structure of the present disclosure.
Figure 2:
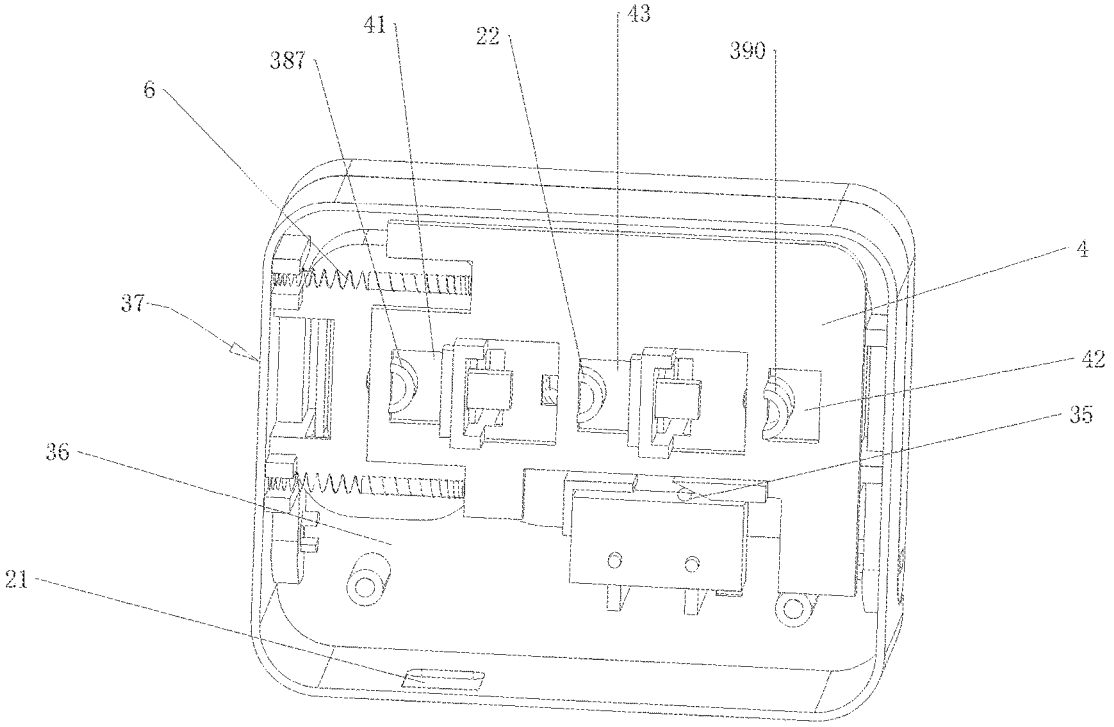
FIG. 2 is a partially exploded diagram of the present disclosure.
Figure 3:
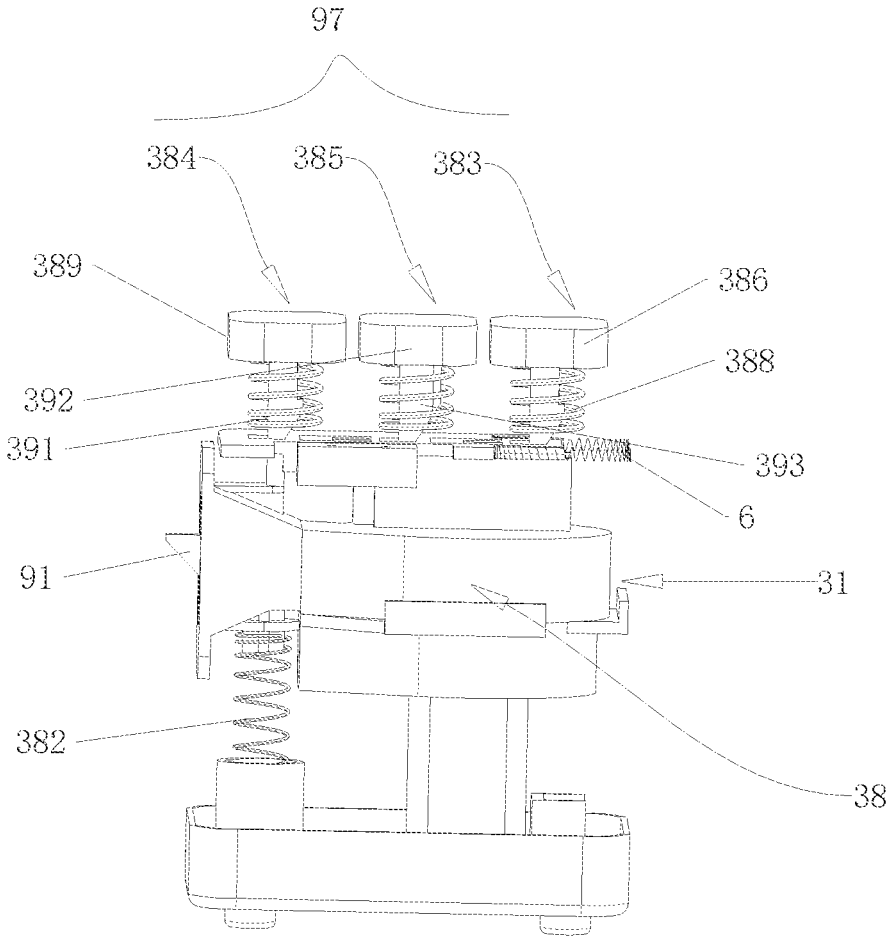
FIG. 3 is another partially exploded diagram of the present disclosure.
Figure 4:
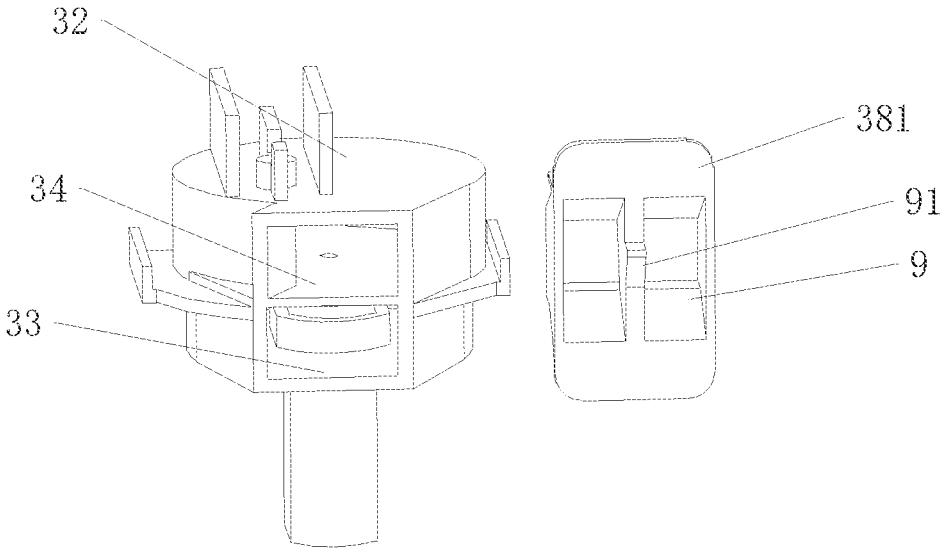
FIG. 4 is an exploded diagram of a fan and a switching gate of the present disclosure.
Figure 5:
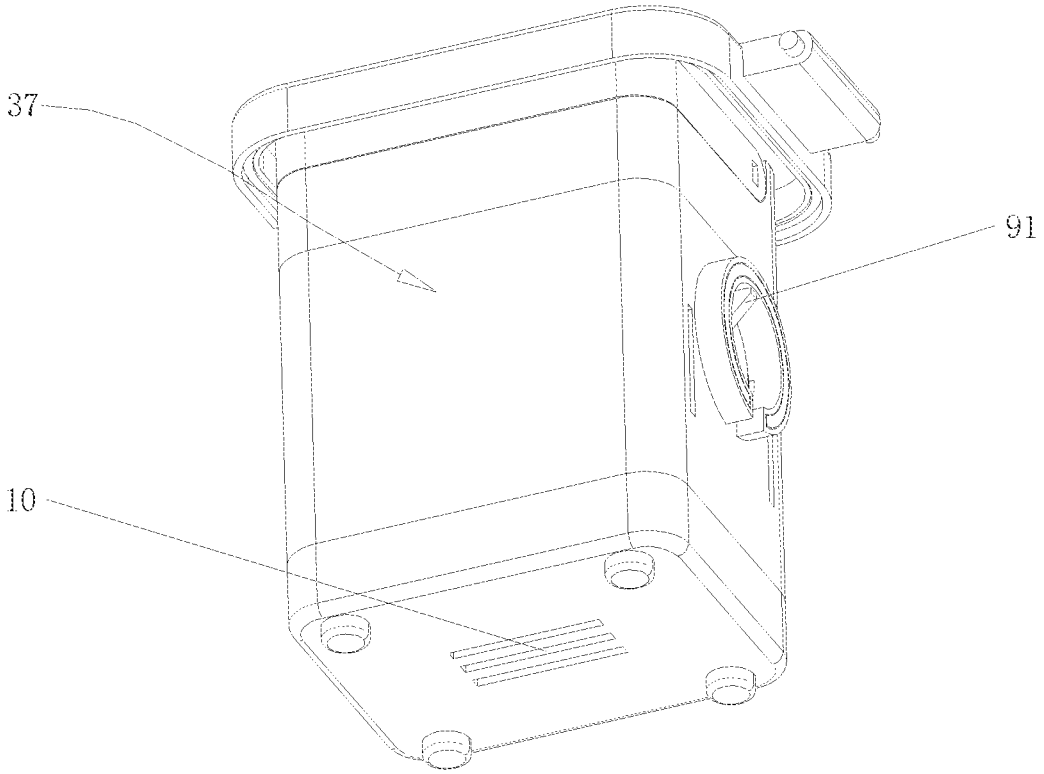
FIG. 5 is a schematic diagram of a partial structure of the present disclosure.
Figure 6:
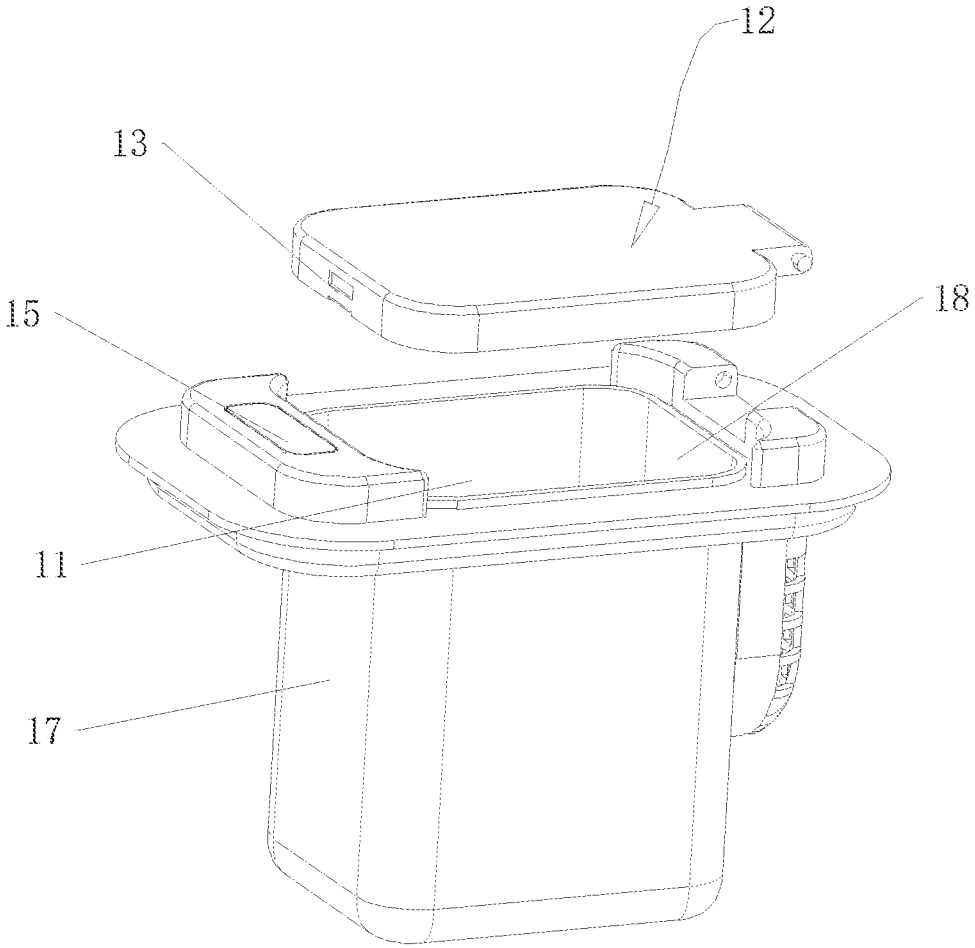
FIG. 6 is an exploded diagram of a partial structure of the present disclosure.
Figure 7:
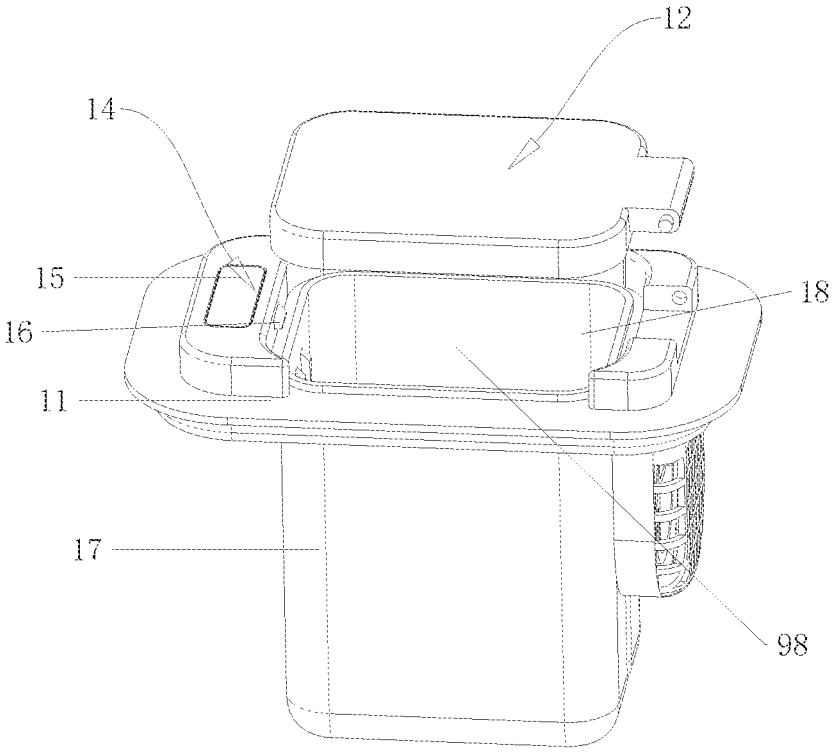
FIG. 7 is an exploded diagram in another angle corresponding to FIG. 6 of the present disclosure.
Figure 8:
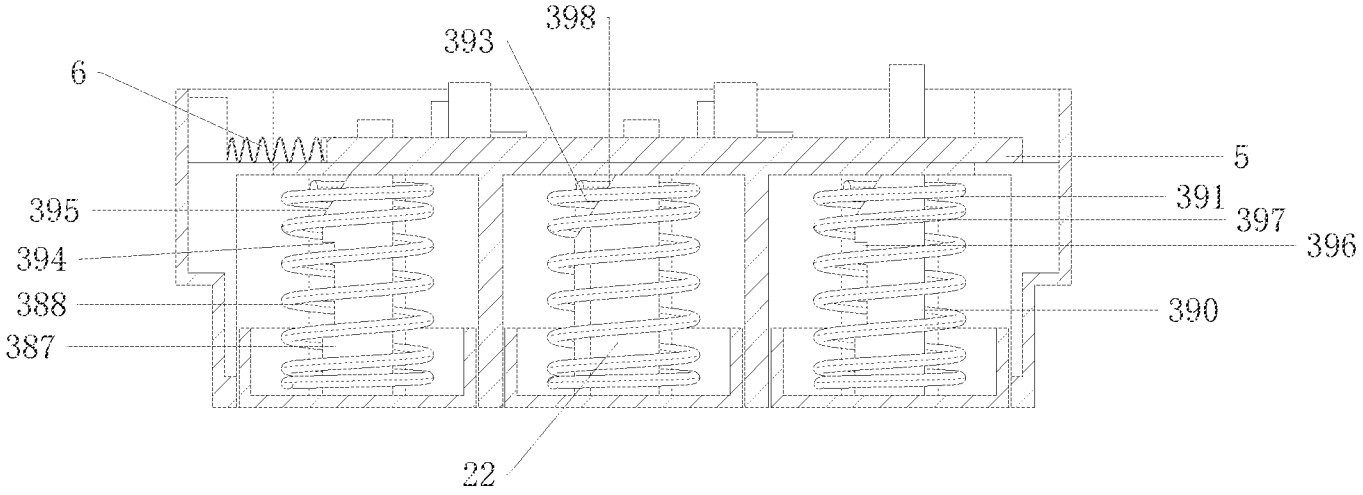
FIG. 8 is an exploded diagram of a push switch of the present disclosure.
Figure 9:
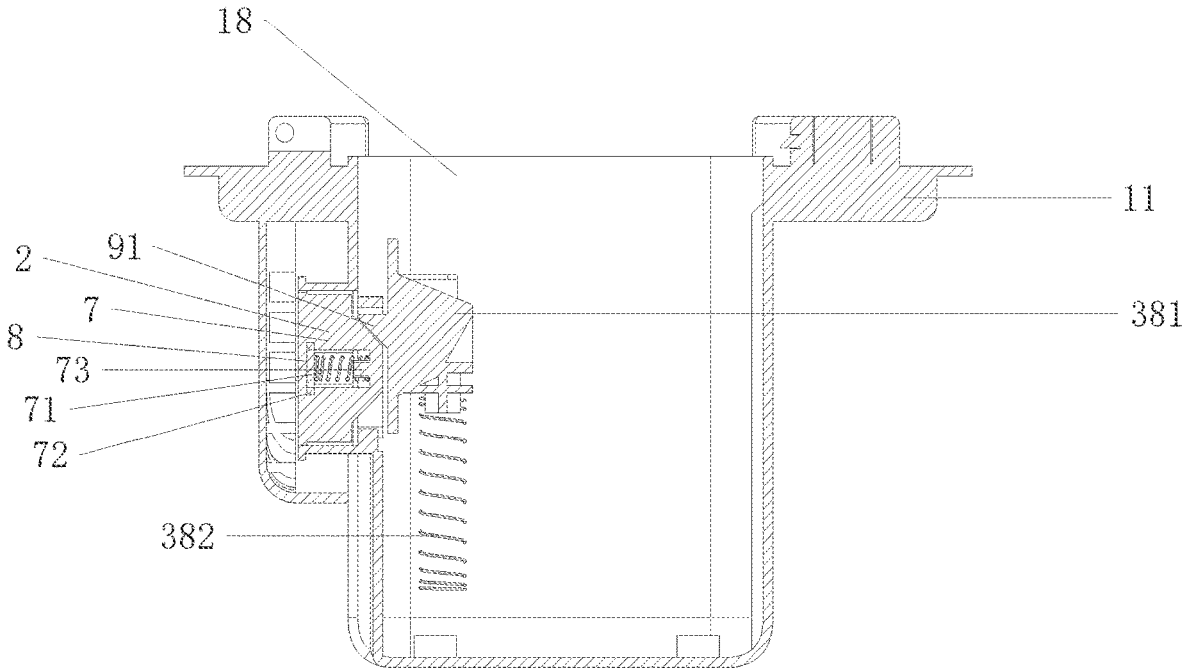
FIG. 9 is a sectional view of a partial structure of the present disclosure.
Figure 10:
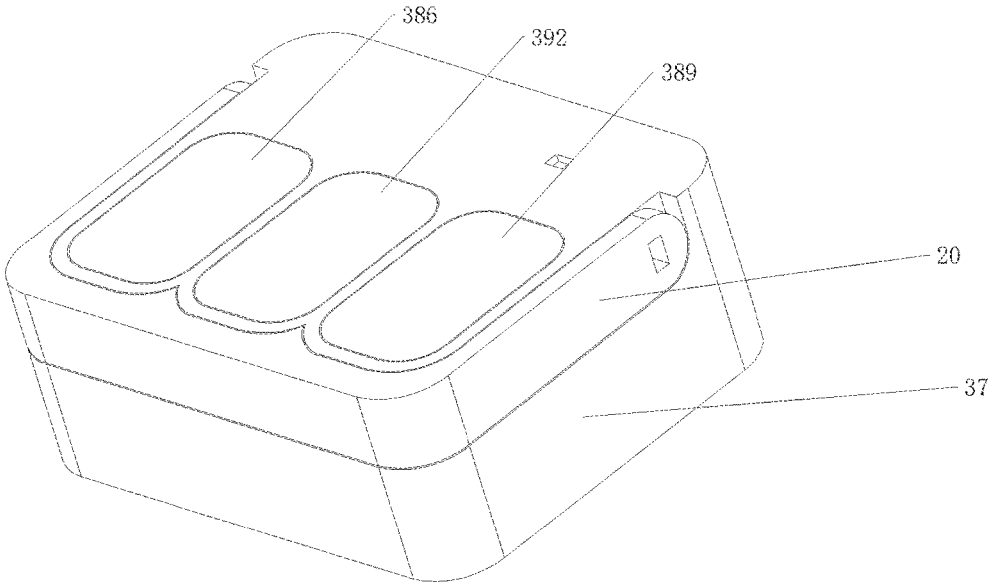
FIG. 10 is a schematic diagram of a partial structure of the present disclosure.
Figure 11:
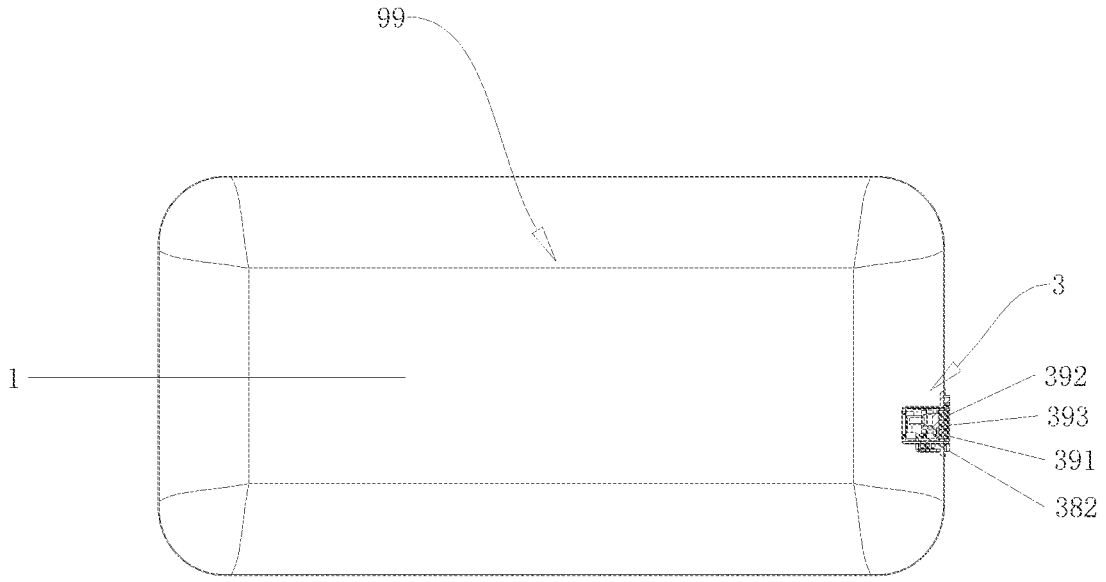
FIG. 11 is a sectional view in one angle of the present disclosure.
Figure 12:
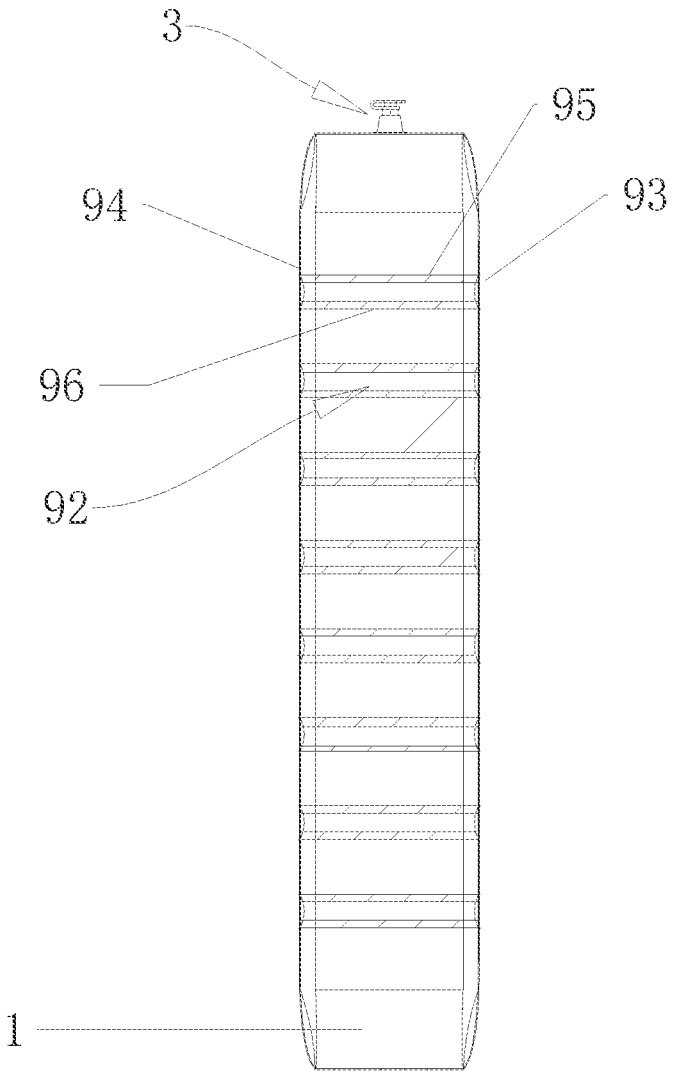
FIG. 12 is a sectional view in another angle of the present disclosure.

The specific embodiments of the present disclosure are described in details in combination with the drawings.

This specific embodiment is only an explanation of the present disclosure, and it is not a limitation to the present disclosure. After reading this specification, those skilled in the art can make modifications to this embodiment that do not create any contribution as needed, but the modifications shall be protected by the patent law within the scope of the claims of the present disclosure.

This embodiment relates to an air mattress, including a mattress main body 99 and an inflation and deflation device 3.

The mattress main body 99 is provided with an inflation chamber 1 and a first airflow channel 2. The inflation chamber 1 is a place for inflating and deflating the air mattress. The first airflow channel 2 is a place where an inflation airflow and a deflation airflow pass through. The inflation chamber 1 is communicated to the first airflow channel 2. The mattress main body 99 includes a first mattress inner wall 93 and a second mattress inner wall 94. A number of third airflow channels 92 are arranged between the first mattress inner wall 93 and the second mattress inner wall 94, so that the mattress main body 99 can be more stable in inflation and deflation states.

In this embodiment, a material of the third airflow channels 92 is a plastic material. The third airflow channels 92 are uniformly distributed between the first mattress inner wall 93 and the second mattress inner wall 94. Two ends of first connecting walls 95 and two ends of second connecting walls 96 of the third airflow channels 92 are fixed to the first mattress inner wall 93 and the second mattress inner wall 94, respectively. In the inflation state, the inflation airflow from the first airflow channel 2 passes through the inflation chamber 1 and the third airflow channels 92, so that the third airflow channels 92 and the air mattress expand; the first mattress inner wall 93 and the second mattress inner wall 94 pull the first connecting walls 95 and the second connecting walls 96 of the third airflow channels 92 to move, which prevents deformation of the air mattress caused by non-uniform air pressure in the air mattress in the inflation state. In this way, pressures on the third airflow channels 92 are the same. Due to the fixed connection between the first connecting walls 95 as well as the second connecting walls 96 and the first mattress inner wall 93 as well as the second mattress inner wall 94, if deformation occurs in the inflation state, both the first connecting walls 95 and the second connecting walls 96 in the third airflow channels 92 will pull the first mattress inner wall 93 and the second mattress inner wall 94, which prevents the influence on the visual effect and a poor use effect caused by an uneven surface of the mattress main body 99 due to non-uniform stress on the mattress main body 99. In the deflation state, due to the fixed connection between the first connecting walls 95 as well as the second connecting walls 96 and the first mattress inner wall 93 as well as the second mattress inner wall 94, if air is discharged from the first airflow channel 2, a volume of the air mattress decreases, and a distance between the first mattress inner wall 93 and the second mattress inner wall 94 decreases, causing deformation of the first connecting walls 95 and second connecting walls 96 of the third airflow channels 92. As the pressures in the third airflow channels 92 are the same, when the deformation occurs, the first connecting walls 95 and second connecting wall 96 of the third airflow channels 92 deform at the same speed. Therefore, in the deflation state, the surface of the air mattress remains flat. In a reset state, the first airflow channel 2 is closed, the pressure in the inflation chamber 1 remains unchanged, and the third airflow channels 92 remains stationary with the air mattress.

The inflation and deflation device 3 includes a driving device 31, a mounting housing 37, and a switching device 38. The driving device 31 is arranged in the mounting housing 37. The driving device 31 includes a fan 32, a conducting switch 35, and a circuit board 36. An output end of the fan 32 includes a first air inlet 33 and a first air outlet 34. The fan 32 is arranged in the mounting housing 37. The fan 32 is further provided with a fan casing to protect the fan 32 from being affected by other parts. A rotating direction of the fan 32 does not change. In this embodiment, the first air inlet 33 is arranged below the first air outlet 34. In other embodiments, the first air inlet 33 can be arranged above the first air outlet 34. The fan 32 is electrically connected to the circuit board 36. The circuit board 36 is electrically connected to the conducting switch 35. The conducting switch 35 and the circuit board 36 jointly control a working state of the fan 32. A USB interface 21 is further formed in a surface of the mounting housing 37. The USB interface 21 is electrically connected to the circuit board 36. The USB interface 21 is electrically connected to an external power source. The external power source supplies power to the driving device 31.

The switching device 38 includes a push switch 97, a switching gate 381, and a first pushing device 382. The switching device 38 is arranged on the mounting housing 37. The switching gate 381 is arranged between the first airflow channel 2 and the first air inlet 33 as well as the first air outlet 34. A second airflow channel 9 is arranged on the switching gate 381 to switch the air mattress between the inflation state and the deflation state. One end of the second airflow channel 9 is communicated to the first airflow channel 2, and the other end of the second airflow channel 9 is located at the first air inlet 33 or the first air outlet 34. The switching gate 381 is connected to the first pushing device 382, and the first pushing device 382 is configured to push the other end of the second airflow channel 9 to be communicated to the first air outlet 34. In this embodiment, the first pushing device 382 pushes the switching gate 381 to communicate the other end of the second airflow channel 9 to the first air outlet 34. The first pushing device 382 is a pushing spring. In other embodiments, the first pushing device 382 can be any elastic reset member that pushes the other end of the second airflow channel 9 to be communicated to the first air outlet 34.

The push switch 97 includes an inflation switch 383, a deflation switch 384, and a reset switch 385. The inflation switch 383 includes an inflation push portion 386, an inflation push rod 387, and a second spring 388. The inflation push portion 386 is connected to the inflation push rod 387. The second spring 388 sleeves the inflation push rod 387. The deflation switch 384 includes a deflation push portion 389, a deflation push rod 390, and a third spring 391. The deflation push portion 389 is connected to the deflation push rod 390. The third spring 391 sleeves the deflation push rod 390. The reset switch 385 includes a reset push portion 392, a reset push rod 22, and a fourth spring 393. The reset push portion 392 is connected to the reset push rod 22, and the fourth spring 393 sleeves the reset push rod 22; The switching device 38 further includes a pushing plate 4 and a fixed plate 5. A first elastic member 6 is arranged between the pushing plate 4 and the mounting housing 37. The first elastic member 6 is configured to push the pushing plate 4 towards one side away from the conducting switch 35. The pushing plate 4 is provided with an inflation through hole 41, a deflation through hole 42, and a reset through hole 43. The inflation through hole 41 allows the inflation push rod 387 to pass through. The deflation through hole 42 allows the deflation push rod 390 to pass through. The reset through hole 43 allows the reset push rod 22 to pass through. The second spring 388, the third spring 391, and the fourth spring 393 are respectively connected to the fixed plate 5. The fixed plate 5 is respectively provided with an inflation opening, a deflation opening, and a reset opening allowing the inflation push rod 387, the deflation push rod 390, and the reset push rod 22 to pass through. The fixed plate 5 abuts against the second spring 388, the third spring 391, and the fourth spring 393. Elastic reset forces generated by compression of the second spring 388, the third spring 391, and the fourth spring 393 cause the push switch 97 to move in a direction away from the fixed plate 5.

The inflation push rod 387 is further provided with a first locking groove 394 and an inflation guide slope 395. The deflation push rod 390 is provided with a second locking groove 396 and a deflation guide slope 397. The reset push rod 22 is provided with a reset guide slope 398. The inflation through hole 41 on the pushing plate 4 includes an inner wall of the inflation through hole 41 and an outer wall of the inflation through hole 41. The outer wall of the inflation through hole 41, the inflation guide slope 395, and the first locking groove 394 cooperate to fix the pushing plate 4. The deflation through hole 42 on the pushing plate 4 includes an inner wall of the deflation through hole 42 and an outer wall of the deflation through hole 42. The outer wall of the deflation through hole 42, the deflation guide slope 397, and the second locking groove 396 cooperate to fix the pushing plate 4. The reset through hole 43 on the pushing plate 4 includes an inner wall of the reset through hole 43 and an outer wall of the reset through hole 43. The outer wall of the reset through hole 43 and the reset guide slope 398 cooperate to push the pushing plate 4 to move in a direction away from the conducting switch 35.

The first airflow channel 2 is internally provided with a second pushing device 7 and a sealing element 8. The second pushing device 7 is connected to the sealing element 8, and the second pushing device 7 is configured to push the sealing element 8 to seal the first airflow channel 2. The sealing element 8 is provided with a first push rod 73. The second pushing device 7 pushes the first push rod 73 to arrange the sealing element 8 on the first airflow channel 2 to seal the first airflow channel 2. The switching gate 381 is provided with a third pushing device 91. The second pushing device 7 includes a first spring 71 and a limiting plate 72. Two ends of the first spring 71 are respectively connected to the first push rod 73 and the limiting plate 72. The first spring 71 sleeves the first push rod 73, and the first spring 71 abuts against the limiting plate 72.

In the inflation state, the inflation switch 383 is triggered, and the inflation push rod 387 passes through the inflation through hole 41 and the inflation opening. The inflation guide slope 395 pushes the pushing plate 4 towards the conducting switch 35, causing the pushing plate 4 to push the conducting switch 35. When the driving device 31 starts to work, and the first elastic member 6 is compressed towards the mounting housing 37. The second spring 388 abuts against the fixed plate 5 and is compressed. The elastic reset force generated by the compression of the second spring 388 can press the pushing plate 4 into the first locking groove 394, and the first locking groove 394 is clamped on the outer wall of the inflation through hole 41. The driving device 31 is configured to drive external air to pass through the first air inlet 33 and the first air outlet 34 in sequence to form the inflation airflow discharged from the first air outlet 34. The first pushing device 382 pushes the switching gate 381 to communicate the other end of the second airflow channel 9 to the first air outlet 34 and to communicate the first airflow channel 2 to the first air outlet 34. The inflation airflow pushes the sealing element 8 in a direction away from the first airflow channel 2. The first spring 71 is compressed towards the limiting plate 72, and the first spring 71 generates a reset force to release the sealing of the sealing element 8 on the first airflow channel 2.

In the deflation state, the deflation switch 384 is triggered, and the deflation push rod 390 passes through the deflation through hole 42 and the deflation opening. The deflation guide slope 397 pushes the pushing plate 4 towards the conducting switch 35, causing the pushing plate 4 to push the conducting switch 35. When the driving device 31 starts to work, and the first elastic member 6 is compressed towards the mounting housing 37. The third spring 391 abuts against the fixed plate 5 and is compressed. The elastic reset force generated by the compression of the third spring 391 can press the pushing plate 4 into the second locking groove 396, and the second locking groove 396 is clamped on the outer wall of the deflation through hole 42. The pushing plate 4 is fixed. The driving device 31 is configured to drive the external air to pass through the first air inlet 33 and the first air outlet 34 in sequence to form the deflation airflow discharged from the first air outlet 34. The deflation push rod 390 pushes the switching gate 381 to switch the second airflow channel 9 to be communicated to the first air inlet 33, which pushes the spring to be compressed. The first airflow channel 2 is communicated to the first air inlet 33. The third pushing device 91 pushes the first push rod 73 to cause the first push rod 73 to push the sealing element 8 in the direction away from the first airflow channel 2. The first spring 71 is compressed towards the limiting plate 72, and the first spring 71 generates the reset force to release the sealing of the sealing element 8 on the first airflow channel 2.

In the reset state, the reset switch 385 is triggered. The reset push rod 22 passes through the reset through hole 43 and the reset opening. The reset guide slope 398 pushes the pushing plate 4 in the direction close to the conducting switch 35, so that the conducting switch 35 is not triggered. The driving device 31 is in a stationary state, and the first elastic member 6 is compressed towards the mounting housing 37. The fourth spring 393 abuts against the fixed plate 5, causing the fourth spring 393 to be compressed. The reset guide slope 398 cooperates with the outer wall of the reset through hole 43 to push the pushing plate 4 in the direction away from the conducting switch 35. A reset force generated by the compression of the first elastic member 6 causes the first elastic member 6 to push the pushing plate 4 towards the side away from the conducting switch 35. The reset force generated by the compression o f the fourth spring 393 causes the reset push rod 22 and the reset push portion 392 to be reset in a direction away from the pushing plate 4.

The mounting housing 37 is provided with an air vent 10, which is convenient for the driving device 31 to suck air into and discharge air out of the air mattress in the inflation and deflation states, so as to keep circulation of air of the air mattress and balance air pressures.

The mattress main body 99 further includes an accommodating housing 11. The accommodating housing 11 is configured to accommodate the inflation and deflation device 3. The accommodating housing 11 is provided with a cover 12. One end of the cover 12 is rotatably connected to the accommodating housing 11, and the other end of the cover 12 is provided with a clamping slot 13. The other end of the accommodating housing 11 is provided with a buckle structure 14. The buckle structure 14 includes a control button 15 and a clamping block 16. The control button 15 controls expansion and contraction of the clamping block 16. The clamping block 16 is embedded in the clamping slot 13. In a stationary state, the clamping block 16 is embedded in the clamping slot 13, and the cover 12 seals the accommodating housing 11. The control button 15 is triggered, so that the clamping block 16 is separated from the clamping slot 13. The cover 12 rotates around one side of the accommodating housing 11 to release the sealing of the cover 12 on the accommodating housing 11.

The first airflow channel 2 is arranged on the accommodating housing 11. The accommodating housing 11 is provided with an outer side wall 17 and an inner side wall 18. The inner side wall 18 is encircled to form an accommodating chamber 98. The inflation and deflation device 3 is arranged in the accommodating chamber 98. The outer side wall 17 is provided with a stop edge 19. The sealing element 8 is arranged on the outer side wall 17. The stop edge 19 is configured to stop the sealing element 8 on the outer side wall 17. The sealing element 8 is prevented from entering the first airflow channel 2 under the driving of the deflation airflow as it may cause an accident in the deflation process.

In this embodiment, the inflation and deflation device 3 and the mounting housing 37 are both arranged in the inflation chamber 1 of the air mattress. The first airflow channel 2 is communicated to the inflation chamber 1, and both the inflation airflow and the deflation airflow enter and exit the air mattress through the first airflow channel 2. In other embodiments, the inflation and deflation device 3 and the mounting housing 37 are both arranged in the inflation chamber 1 of the air mattress. The first airflow channel 2 is communicated to the inflation chamber 1, and the inflation airflow enters the air mattress through the first airflow channel 2. A surface of the air mattress is provided with an air outlet. The air outlet is used for deflation. The air outlet and an air inlet are respectively arranged in two portions of the air mattress.

In this embodiment, the mounting housing 37 is further provided with a handle 20 for a user to hold, and two ends of the handle 20 are rotatably connected to two sides of the mounting housing 37.

The above is only the preferred embodiments of the present disclosure, and is not intended to limit the present disclosure. Any modifications, equivalent replacements and improvements that are made within the spirit and principle of the present disclosure shall fall within the protection scope of the present disclosure.

What is claimed is:

1. An air mattress, comprising:

a mattress main body, wherein the mattress main body is provided with an inflation chamber and a first airflow channel, and the inflation chamber is communicated to the first airflow channel;

an inflation and deflation device, wherein the inflation and deflation device comprises a driving device; an output end of the driving device is a first air inlet and a first air outlet; when the first air outlet is communicated to the first airflow channel, the inflation and deflation device is in an inflation state, and the driving device is configured to drive external air to pass through the first air inlet and the first air outlet in sequence to form an inflation airflow discharged from the first air outlet; and the inflation airflow discharged from the first air outlet fills the inflation chamber through the first airflow channel to inflate the mattress main body;

wherein the inflation and deflation device further comprises a switching device; the switching device is configured to switch the inflation and deflation device between the inflation state and the deflation state; when the switching device switches the first air outlet to be communicated to the first airflow channel, the inflation and deflation device is in the inflation state, and the driving device is configured to drive the external air to pass through the first air inlet and the first air outlet in sequence to form the inflation airflow discharged from the first air outlet; the inflation airflow discharged from the first air outlet fills the inflation chamber through the first airflow channel to inflate the mattress main body; and when the switching device switches the first air inlet to be communicated to the first airflow channel, the inflation and deflation device is in the deflation state, and the driving device is configured to drive the air in the inflation chamber to pass through the first air inlet and the first air outlet in sequence to form the exhaust airflow discharged from the first air outlet to the outside to deflate the mattress main body;

wherein the inflation and deflation device further comprises a mounting housing, and the driving device is arranged inside the mounting housing;

wherein the switching device is arranged on the mounting housing; the driving device is provided with a conducting switch; the switching device comprises a push switch, a switching gate, and a first pushing device; the switching gate is arranged between the first airflow channel and the first air inlet a second airflow channel is arranged on the switching gate; one end of the second airflow channel is communicated to the first airflow channel, and an other end of the second airflow channel is located at the first air inlet or the first air outlet the switching gate is connected to the first pushing device; the first pushing device pushes the switching gate to switch the other end of the second airflow channel to be located at the first air outlet, and the second airflow channel is communicated to the first air outlet; the push switch comprises a deflation switch; when the deflation switch is triggered, the conducting switch is triggered to cause the driving device to be in a working state; the deflation switch is configured to push the switching gate to switch the second airflow channel to be located at the first air inlet; and the second airflow channel is communicated to the first air inlet;

wherein the first airflow channel is internally provided with a second pushing device and a sealing element the second pushing device is connected to the sealing element and the second pushing device is configured to push the sealing element to seal the first airflow channel;

wherein the sealing element is provided with a first push rod; the second pushing device pushes the first push rod; the sealing element seals the first airflow channel; the switching gate is provided with a third pushing device; in the inflation state, the inflation airflow pushes the sealing element in a direction away from the first airflow channel, so as to release the sealing of the sealing element on the first airflow channel; when the deflation switch is triggered, the deflation switch is configured to push the switching gate to communicate the second airflow channel to the first air inlet and the third pushing device pushes the first push rod to cause the first push rod to push the sealing element in the direction away from the first airflow channel, so as to release the sealing of the sealing element on the first airflow channel.

2. The air mattress according to claim 1, wherein when the first air inlet is communicated to the first airflow channel, the inflation and deflation device is in a deflation state, and the driving device is configured to drive the air in the inflation chamber to pass through the first air inlet and the first air outlet in sequence to form an exhaust airflow discharged from the first air outlet to the outside to deflate the mattress main body.

3. The air mattress according to claim 1, wherein the second pushing device comprises a first spring and a limiting plate; two ends of the first spring are respectively connected to the first push rod and the limiting plate; the first spring sleeves the first push rod; the first spring abuts against the limiting plate; in the inflation state, the inflation airflow pushes the sealing element in the direction away from the first airflow channel, so as to release the sealing of the sealing element on the first airflow channel; the first spring is compressed in a direction close to the limiting plate; the first spring generates a reset force; when the deflation switch is triggered, the deflation switch is configured to push the switching gate to communicate the second airflow channel to the first air inlet; the third pushing device pushes the first push rod to cause the first push rod to push the sealing element in the direction away from the first airflow channel, so as to release the sealing of the sealing element on the first airflow channel; the first spring is compressed in the direction close to the limiting plate; and the first spring generates the reset force.

4. The air mattress according to claim 3, wherein the push switch further comprises an inflation switch; when the inflation switch is triggered, the conducting switch is triggered to cause the driving device to be in the working state; the driving device is configured to drive the external air to pass through the first air inlet and the first air outlet in sequence, so as to form the inflation airflow discharged from the first air outlet; the inflation airflow pushes the sealing element in the direction away from the first airflow channel, so as to release the sealing of the sealing element on the first airflow channel; the push switch further comprises a reset switch; the reset switch is configured to release the triggering on the inflation switch and the driving device, so that the driving device is in a non-working state to eliminate the inflation airflow, so as to cause the second pushing device to push the sealing element to seal the first airflow channel; and the reset switch is further configured to release the triggering on the deflation switch and the driving device, so that the driving device is in the non-working state to release the pushing on the first push rod by the third pushing device, and the second pushing device pushes the sealing element to seal the first airflow channel.

5. The air mattress according to claim 4, wherein the switching device further comprises a pushing plate; when the inflation switch is triggered, the inflation switch pushes the pushing plate towards the conducting switch, causing the pushing plate to push the conducting switch to trigger the conducting switch; when the deflation switch is triggered, the inflation switch pushes the pushing plate towards the conducting switch, causing the pushing plate to push the conducting switch to trigger the conducting switch; and when the reset switch is triggered, the reset switch is configured to push the pushing plate in a direction away from the conducting switch to release the triggering on the conducting switch.

6. The air mattress according to claim 5, wherein the inflation switch comprises an inflation push portion, an inflation push rod, and a second spring; the inflation push portion is connected to the inflation push rod; the second spring sleeves the inflation push rod; when the push portion is triggered, the second spring is compressed, and the inflation push rod pushes the pushing plate towards the conducting switch, causing the pushing plate to push the conducting switch, so that the driving device is in the working state; the deflation switch comprises a deflation push portion, a deflation push rod, and a third spring; the deflation push portion is connected to the deflation push rod; the third spring sleeves the deflation push rod; when the deflation push portion is triggered, the third spring is compressed, and the deflation push rod pushes the pushing plate towards the conducting switch, causing the pushing plate to push the conducting switch, so that the driving device is in the working state; the reset switch comprises a reset push portion, a reset push rod, and a fourth spring; the reset push portion is connected to the reset push rod; the fourth spring sleeves the reset push rod; when the reset push portion is triggered, the reset push rod pushes the pushing plate in the direction away from the conducting switch; and an elastic reset force generated by compression of the fourth spring pushes the reset push rod and the reset push portion to be reset in a direction away from the pushing plate.

7. The air mattress according to claim 6, wherein the pushing plate is provided with a first elastic member; the first elastic member is configured to push the pushing plate towards one side away from the conducting switch, and the inflation push rod is further provided with a first locking groove; when the inflation push portion is triggered, the inflation push rod pushes the pushing plate towards the conducting switch; the first elastic member is compressed, and the second spring is compressed, so that the pushing plate pushes the conducting switch, and an elastic reset force generated by the compression of the second spring presses the pushing plate into the first locking groove to cause the inflation push portion to be in a triggered state; the deflation push rod is further provided with a second locking groove; when the deflation push portion is triggered, the deflation push rod pushes the pushing plate towards the conducting switch; the first elastic member is compressed, and the third spring is compressed, so that the pushing plate pushes the conducting switch, and an elastic reset force generated by the compression of the third spring presses the pushing plate into the second locking groove to cause the deflation push portion to be in a triggered state; when the reset push portion is triggered, the reset push rod pushes the pushing plate towards a direction close to the first elastic member, and the first elastic member is compressed; the first elastic member is configured to push the pushing plate towards the side away from the conducting switch, and the fourth spring is compressed; and an elastic reset force generated by the compression of the fourth spring pushes the reset push rod and the reset push portion to be reset in the direction away from the pushing plate.

8. The air mattress according to claim 7, wherein the pushing plate is provided with an inflation through hole, a deflation through hole, and a reset through hole; the inflation through hole allows the inflation push rod to pass through; the deflation through hole allows the deflation push rod to pass through; the reset through hole allows the reset push rod to pass through; the second spring, the third spring, and the fourth spring are respectively connected to a fixed plate; the fixed plate is respectively provided with an inflation opening, a deflation opening, and a reset opening allowing the inflation push rod, the deflation push rod, and the reset push rod to pass through; when the inflation push portion is triggered, the inflation push rod passes through the inflation through hole and the inflation opening, and the inflation push rod pushes the pushing plate towards the conducting switch, causing the pushing plate to push the conducting switch; the first elastic member is compressed, and the second spring abuts against the fixed plate and is compressed; the elastic reset force generated by the compression of the second spring presses the pushing plate into the first locking groove; the first locking groove is clamped on an outer wall of the inflation through hole to cause the inflation push portion to be in a triggered state; when the deflation push portion is triggered, the deflation push rod passes through the deflation through hole and the deflation opening, and the deflation push rod pushes the pushing plate towards the conducting switch, causing the pushing plate to push the conducting switch; the first elastic member is compressed, and the third spring abuts against the fixed plate and is compressed; the elastic reset force generated by the compression of the third spring presses the pushing plate into the second locking groove; the second locking groove is clamped on an outer wall of the deflation through hole to cause the deflation push portion to be in a triggered state; when the reset push portion is triggered, the reset push rod passes through the reset through hole and the reset opening, and the reset push rod pushes the pushing plate towards the conducting switch; the first elastic member is compressed, and the first elastic member is configured to push the pushing plate towards the side away from the conducting switch; the fourth spring abuts against the fixed plate and is compressed; and the elastic reset force generated by the compression of the fourth spring pushes the reset push rod and the reset push portion to be reset in the direction away from the pushing plate.

9. The air mattress according to claim 1, wherein the driving device further comprises a fan and a circuit board; the fan is configured to transfer an airflow to the air mattress for inflation and deflation; the circuit board is electrically connected to the fan; the conducting switch is electrically connected to the circuit board; the conducting switch and the circuit board jointly control a working state of the fan; a USB interface is formed in a surface of the mounting housing; the USB interface is electrically connected to the circuit board; the USB interface is electrically connected to an external power source; and the external power source is configured to supply power to the driving device.

10. The air mattress according to claim 9, wherein the fan is provided with a fan casing; the fan casing is arranged inside the mounting housing; an output end of the fan comprises the first air inlet and the first air outlet; and the first air inlet is arranged below the first air outlet.

11. The air mattress according to claim 9, wherein the fan is provided with a fan casing; and the fan casing is arranged inside the mounting housing.

12. The air mattress according to claim 1, wherein the mounting housing is provided with an air vent for the fan to suck air into and discharge air out of the air mattress in the inflation and deflation states.

13. The air mattress according to claim 1, wherein the mattress main body further comprises an accommodating housing; the accommodating housing is configured to accommodate the inflation and deflation device; the accommodating housing is provided with a cover; one end of the cover is rotatably connected to the accommodating housing, and an other end of the cover is provided with a clamping slot; an end of the accommodating housing is provided with a buckle structure; the buckle structure comprises a control button and a clamping block; the control button controls expansion and contraction of the clamping block; the clamping block is embedded in the clamping slot; in a stationary state, the clamping block is embedded in the clamping slot, and the cover seals the accommodating housing; the control button is triggered, so that the clamping block is separated from the clamping slot; and the cover rotates around one side of the accommodating housing to release the sealing of the cover on the accommodating housing.

14. The air mattress according to claim 13, wherein the first airflow channel is arranged on the accommodating housing; the accommodating housing is provided with an outer side wall and an inner side wall; the inner side wall is encircled to form an accommodating chamber; the inflation and deflation device is arranged in the accommodating chamber; the outer side wall is provided with a stop edge; the sealing element is arranged on the outer side wall; and the stop edge is configured to stop the sealing element on the outer side wall.

15. The air mattress according to claim 1, wherein the mattress main body comprises a first mattress inner wall and a second mattress inner wall; a number of third airflow channels are arranged between the first mattress inner wall and the second mattress inner wall; the third airflow channels comprise a first connecting wall and a second connecting wall; two ends of the first connecting wall and two ends of the second connecting wall are respectively connected to the first mattress inner wall and the second mattress inner wall; a distance is reserved between the two ends of the first connecting wall and the two ends of the second connecting wall; the third airflow channels are formed between the two ends of the first connecting wall and the two ends of the second connecting wall; and the third airflow channels are uniformly distributed between the first mattress inner wall and the second mattress inner wall.

* * * * *